US009825402B2

(12) United States Patent
Köllmann et al.

(10) Patent No.: US 9,825,402 B2
(45) **Date of Patent: *Nov. 21, 2017**

(54) CONDUCTOR TERMINAL

(71) Applicant: WAGO Verwaltungsgesellschaft mbH, Minden (DE)

(72) Inventors: Hans-Josef Köllmann, Minden (DE); Wolfgang Gerberding, Hess. Oldendorf (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/335,646

(22) Filed: Oct. 27, 2016

(65) Prior Publication Data

US 2017/0047680 A1 Feb. 16, 2017

Related U.S. Application Data

(63) Continuation of application No. 14/767,525, filed as application No. PCT/EP2014/052715 on Feb. 12, 2014, now Pat. No. 9,543,700.

(30) Foreign Application Priority Data

Feb. 13, 2013 (DE) ..... 10 2013 101 406

(51) Int. Cl.
*H01R 13/627* (2006.01)
*H01R 13/629* (2006.01)
(Continued)

(52) U.S. Cl.
CPC ..... *H01R 13/62905* (2013.01); *H01R 4/4836* (2013.01); *H01R 13/6275* (2013.01); *H01R 13/639* (2013.01); *H01R 4/4845* (2013.01)

(58) Field of Classification Search
CPC .. H01R 4/4818; H01R 4/4827; H01R 4/4836; H01R 2103/00; H01R 13/193;
(Continued)

(56) References Cited

U.S. PATENT DOCUMENTS 2,590,886 A * 4/1952 Pedersen ..... H01R 13/582 439/463
3,895,635 A * 7/1975 Justus ..... A61B 5/0424 439/140
(Continued)

FOREIGN PATENT DOCUMENTS

DE 1 575 118 4/1970
DE 87 04 494 6/1987
(Continued)

OTHER PUBLICATIONS

International Search Report for corresponding International application No. PCT/EP2014/052715 dated May 12, 2014.
(Continued)

*Primary Examiner* — Abdullah Riyami
*Assistant Examiner* — Vladimir Imas
(74) *Attorney, Agent, or Firm* — Renner, Otto, Boisselle & Sklar, LLP

(57) ABSTRACT

A conductor terminal having an insulating material housing and having at least one spring-loaded clamping connection in the insulating material housing and also having at least one actuation element, which is pivotably accommodated in the insulating material housing and is designed to open in each case at least one associated spring-loaded clamping connection, is described. The actuation element has two side wall portions which are spaced from one another and at least partially enter the insulating material housing with a pivot bearing region and, opposite said pivot bearing region, are connected to each other by a transverse web to form a lever
(Continued)

arm. The pivot bearing regions of the mutually distanced side wall portions of an actuation element form an axis of rotation, about which the actuation element is pivotably mounted in the insulating material housing. An associated spring-loaded clamping connection is at least partially accommodated in the space between the pivot bearing regions of an actuation element. The pivot bearing regions have actuation portions, which in each case are designed in order to act on an associated clamping spring of a spring-loaded clamping connection as the actuation element is pivoted from a closed position into an open position. The adjacent side wall portions of two actuation elements arranged adjacently in the insulating material housing border one another directly.

11 Claims, 7 Drawing Sheets

(51) Int. Cl.
*H01R 4/48* (2006.01)
*H01R 13/639* (2006.01)

(58) Field of Classification Search
CPC .. H01R 13/20; H01R 13/639; H01R 13/6392; H01R 4/4845; H01R 9/093; H01R 13/6395
USPC ..... 439/835, 441, 729
See application file for complete search history.

(56) References Cited

U.S. PATENT DOCUMENTS 4,253,719 A * 3/1981 McGinley ..... H01R 12/721 439/329
4,647,131 A * 3/1987 Van Woensel ..... H01R 12/774 439/260
4,678,264 A * 7/1987 Bowen ..... G02B 6/3817 385/88
4,761,143 A * 8/1988 Owens ..... A61B 18/16 439/372
5,295,872 A * 3/1994 Christensson ..... A61N 1/048 439/822
5,944,562 A 8/1999 Christensson
5,975,940 A * 11/1999 Hartmann ..... H01R 4/4818 439/441
6,261,120 B1 * 7/2001 Beege ..... H01R 4/4836 439/268
6,357,089 B1 * 3/2002 Koguchi ..... A61B 5/0416 24/330
6,595,809 B2 * 7/2003 Matsumoto ..... H01R 4/4827 439/372
6,780,065 B2 * 8/2004 Schwarz ..... A61N 1/048 439/310
7,766,689 B2 * 8/2010 Knoerrchen ..... H01R 4/4836 439/437
8,062,077 B2 * 11/2011 Hayashi ..... H01R 4/4863 439/725
8,129,641 B2 * 3/2012 Majewski ..... H01R 4/4836 200/335
8,444,443 B2 * 5/2013 Schafmeister ..... H01R 4/4836 439/441
8,475,191 B2 * 7/2013 Schafmeister ..... H01R 4/4836 439/266
8,727,819 B2 * 5/2014 Giefers ..... H01R 4/489 439/441
2007/0144011 A1 * 6/2007 Ducret ..... H02G 1/005 30/90.1
2010/0036231 A1 * 2/2010 Hobet ..... A61B 5/0408 600/394

FOREIGN PATENT DOCUMENTS

| | | |
|---|---|---|
| DE | 38 22 980 | 1/1990 |
| DE | 299 15 515 | 2/2001 |
| DE | 10 2007 050 936 | 5/2009 |
| DE | 20 2009 010 003 | 12/2009 |
| DE | 10 2010 024 809 | 12/2011 |
| EP | 1 622 224 | 6/2009 |
| EP | 2 325 947 | 5/2011 |
| EP | 2 445 056 | 4/2012 |
| JP | 2006 012634 | 1/2006 |

OTHER PUBLICATIONS

International Preliminary Report on Patentability for corresponding International application No. PCT/EP2014/052715 dated Aug. 27, 2015.
European Search Report for corresponding European application No. 16173966.9 dated Sep. 19, 2016. English translation not available.

* cited by examiner

CONDUCTOR TERMINAL

RELATED APPLICATION DATA

This application is a continuation of application Ser. No. 14/767,525, filed on Aug. 12, 2015.

BACKGROUND

The invention relates to a conductor terminal having an insulating material housing and having at least one spring-loaded clamping connection in the insulating material housing and also having at least one actuation element, which is pivotably accommodated in the insulating material housing and is designed to open in each case at least one associated spring-loaded clamping connection.

Conductor terminals are known in a variety of forms, for example as box terminals, circuit board terminals, series terminals or as conductor terminals in other electrical apparatuses.

DE 299 15 515 U1 discloses a spring clip for connecting electrical conductors to an insulating material housing, which has a terminal with a clamping spring cooperating with a bus bar piece. An actuation element in the form of a cam lever is integrated in the insulating material housing and is mounted rotatably in the insulating material housing. The axis of rotation of the cam lever is arranged substantially perpendicularly above the clamping point. This leads to a relatively large installation height.

A terminal having a spring-loaded clamping connection and an actuation lever is known from DE 87 04 494 U1, in which the actuation lever is mounted pivotably via its axis of rotation behind the clamping point below the clamping spring, as considered in the conductor insertion direction. An actuation tab is bent at the free clamping limb end and cooperates with an actuation finger of the actuation lever in order to open the spring-loaded clamping connection.

EP 1 622 224 B1 discloses a terminal having an actuation lever, which is mounted rotatably in a bend of a bus bar. The clamping point between clamping spring end and bus bar is provided below the axis of rotation. The actuation lever is arranged with an actuation portion in the clamping space bordering the conductor insertion opening DE 20 2009 010 003 U1 presents a connection terminal having a separating lever with pivot means for pivoting a connection spring with respect to a bus bar piece. The separating lever is mounted on a cavity, formed by the bus bar piece, for forming the pivot axis, such that, by means of an actuation finger to be acted on by hand with a lever actuation force and by means of a contact portion for actuating the clamping spring, a lever arm pivotable about the axis of rotation therebetween is formed.

Furthermore, a terminal having an insulating material housing, a bus bar portion and having at least one spring clamping unit with a clamping spring is described in 10 2010 024 809 A1. The clamping spring has an actuation portion, which proceeds from a clamping portion and which extends away from the direction of the spring force of the clamping spring acting at the clamping portion, and is oriented for application by a pivotably mounted actuation lever, such that the actuation lever applies a tensile force to the actuation portion, said tensile force acting counter to the spring force, in order to open the clamping spring.

SUMMARY OF THE INVENTION

Proceeding on this basis, the object of the present invention is to create an improved conductor terminal, which can be constructed so as to be as small as possible, having an insulating material housing and having at least one spring-loaded clamping connection in the insulating material housing and also having at least one actuation element, which is pivotably accommodated in the insulating material housing and is designed to open in each case at least one associated spring-loaded clamping connection. The conductor terminal will also be optimized in view of the influence of force of the actuation element on the insulating material housing and the force transmission of the lever pivot force, applied externally to the actuating element, to the actuation force, which acts on the clamping spring.

The object is achieved by the conductor terminal having the features of claim 1. Advantageous embodiments are described in the dependent claims.

It is proposed that the actuation element of a generic conductor terminal has two side wall portions which are spaced from one another and at least partially enter the insulating material housing with a pivot bearing region and, at a distance from said pivot bearing region, are connected to each other by a transverse web to form a lever arm. The actuation element is pivotably mounted in the insulating material housing with the pivot bearing regions of the mutually distanced side wall portions of an actuation element. An associated spring-loaded clamping connection is then at least partially accommodated in the space between the pivot bearing regions of an actuation element.

The actuation element thus forms an actuation lever, which is approximately U-shaped in section and which at least partially accommodates the spring-loaded clamping connection in the free space delimited laterally by the side wall portions. The pivot bearing regions therefore are not located above, below, in front of or behind the spring-loaded clamping connection, but are located to the side of the spring-loaded clamping connection or to the side of the clamping spring that is to be actuated of the spring-loaded clamping connection.

A very compact conductor terminal is thus provided, with which the actuation lever, with the pivot bearing regions arranged to the side of the spring-loaded clamping connection in the insulating material housing, is mounted pivotably in the insulating material housing in a stable position and in a robust manner.

A significant compact design with optimal guidance and mounting of the actuation elements is achieved when the adjacent side wall portions of two actuation elements arranged adjacently in the insulating material housing border one another directly. The outer walls of the side wall portions of adjacently arranged actuation elements serve here for mutual guidance and give the adjacent actuation element additional support.

The pivot bearing regions have actuation portions which in each case are designed in order to act on an associated clamping spring of a spring-loaded clamping connection as the actuation element pivots from a closed position, in which the actuation element is pivoted with its transverse web in the direction of the insulating material housing and a clamping point formed by the spring-loaded clamping connection for clamping an electrical conductor is closed, into an open position, in which the actuation element with its transverse web is pivoted away from the insulating material housing and a clamping point formed by the spring-loaded clamping connection for clamping an electrical conductor is open.

In a preferred embodiment, two actuation portions can be arranged on the pivot bearing regions of the side wall portions at a distance from one another that is shorter than the distance between the side wall portions. Here, the actuation portions extend parallel to the side wall portions and are formed integrally with the side wall portions, such that in each case a guide slot is provided between an actuation portion and the associated, directly adjacent side wall portion. A guide web of the insulating material housing in each case then enters an associated guide slot for guiding the actuation element in the event of a pivot motion about a pivot axis in the pivot bearing region.

With the aid of the actuation portions distanced from the side walls of the U-shaped lever arm by an intermediate guide slot, the lever arm can be mounted pivotably in a manner secured against tilting by means of a guide web of the insulating material housing entering a respective guide slot. Very stable pivot bearings can be provided in a space-saving manner with the aid of the guide slots and the guide webs engaging therewith, said pivot bearings being arranged substantially to the side of the spring-loaded clamping connections.

Due to the cooperation of the described measures, an extremely compact conductor terminal is provided, of which the pivot levers are pivotably mounted in a stable manner in the insulating material housing, without actuation forces acting on the at least one pivot lever excessively loading the insulating material housing.

In a preferred embodiment the actuation element is coordinated with the insulating material housing and the associated spring-loaded clamping connection in such a way that the lever pivot force acting on the transverse web in order to pivot the actuation element from the closed position into the open position and the spring actuation force acting on the clamping spring by the actuation portions when pivoting the actuation element from the closed position into the open position act on the same side relative to the axis of rotation.

Due to the positioning of the rotation area in the insulating material housing by corresponding design of the pivot bearing regions and by suitable arrangement of the actuation portions relative to the clamping spring, the lever pivot force applied externally to the actuation lever acts on the same side of the rotational area with respect to the rotational area as the spring actuation force applied to the clamping spring by the actuation portions. A kinematic is thus provided that enables a very compact construction of a conductor terminal with optimal force transmission. In particular, the lever pivot force and the spring actuation force can act in the same direction, i.e. upwardly or downwardly. Here, "upwardly" is understood to mean a direction that is in principle independent of the exact angle of extension, corresponding to the extension direction of an open lever arm pointing toward the free end. The term "downwardly" is understood to mean the opposite direction irrespective of the exact angular position. It is therefore irrelevant whether the forces act equally parallel to one another.

The insulating material housing is preferably formed in two parts with a terminal housing part and a separate cover part. The terminal housing part and the cover part are connected to one another in the assembled state by means of the at least one spring-loaded clamping connection, inserted into the terminal housing part, and associated actuation element. The pivot bearing region is then accommodated in an intermediate space formed between the terminal housing part and cover part.

This spring-loaded clamping connection and the associated actuation element can thus be placed firstly in the terminal housing part in the event of assembly. The conductor terminal is then closed in the terminal housing part by latching the cover part. Due to the arrangement of the pivot bearing region in an intermediate space between the terminal housing part and cover part, portions both of the terminal housing part and the cover part can then contribute to the pivot bearing of the pivot bearing region. For this purpose, these bearing portions are preferably curved over part of a circle and are matched with corresponding part-circle curvatures of end faces of the pivot bearing region.

The terminal housing part and/or the cover part here preferably have part-circle bearing cavities for pivotably mounting the actuation element in the insulating material housing. A part-circle outer periphery of the pivot-bearing region matched accordingly with the part-circle bearing cavity then enters an associated bearing cavity.

It is particularly advantageous when the actuation portions have a part-circle outer periphery with a V-shaped incision for forming a step protruding in the direction of the center of the actuation portion. The at least one spring-loaded clamping connection in each case has a bus bar portion and a clamping spring with an actuation tab. The actuation tab of the clamping spring rests on the step as the actuation element is pivoted in order to open a clamping point formed between a clamping edge of the clamping spring and the bus bar portion for clamping an electrical conductor.

With the aid of such a step, which is adjoined by a free space arranged thereabove, a stable support for an actuation tab of the clamping spring is created, such that the spring actuation force is transmitted optimally via the step to the clamping tab of the clamping spring. Due to the step protruding in the direction of the center of the actuation portion, a free space arranged thereabove is provided, such that the clamping spring otherwise may lift freely from the step, even without lever actuation, in order to exert a spring clamping force on the electrical conductor in a manner uninfluenced by the lever arm.

The side wall portions of an actuation element are preferably connected to one another by means of a transverse web formed in such a way that the transverse web, in the state in which the actuation element is pivoted up, in which state the clamping point is open, extends from the free end of the side wall portions to the insulating material housing. An optimal stability of the lever arm in particular in view of the resistance to twisting and resistance to bending is thus achieved with utilization of the available installation space.

The transverse web preferably protrudes beyond the free end of the side wall portions opposite the pivot bearing region. An attachment for grasping the transverse web and exerting a lever pivot force is thus provided. Due to the protruding end of the transverse web, the lever arm can be better grasped by hand or can be grasped from below by means of a screwdriver in order to be opened.

The conductor terminal is preferably embodied as a transverse connection terminal, such as a box terminal, in which two or more spring-loaded clamping connections are accommodated adjacently in the insulating material housing, wherein the spring-loaded clamping connections have a common bus bar. An electrical conductor connected to a spring-loaded clamping connection is thus connected electrically conductively to further electrical conductors, which are connected to the other spring-loaded clamping connections.

Such a box terminal is extremely compact and can be integrated advantageously in distributor boxes of electrical installations. With the aid of the actuation lever, a simple clamping and removal of electrical conductors is possible for a large range of conductor cross sections. A conductor terminal of this type can therefore be used not only for energy distribution installations, but also for communication technology installations.

A very stable mounting of the actuation elements in the insulating material housing can be achieved when the pivot bearing regions are mounted on a portion of a bus bar of the associated spring-loaded clamping connection. Here, the generally very stable, solid bus bar forms a support for the actuation element, such that the bus bars with the associated clamping spring and the actuation element are substantially self-supporting with regard to the effects of force and moments, without relatively large forces and moments acting on the insulating material housing in the event of actuation of the spring-loaded clamping connection by pivoting of the actuation element.

It is also advantageous when the external contours of the actuation portions lie in the space between the plane spanned by a bus bar of the associated spring-loaded clamping connection and a plane spanned by a contact limb of the associated spring-loaded clamping connection. This enables a very compact construction with optimal force effect of the actuation element on the spring-loaded clamping connection.

The invention will be explained in greater detail hereinafter on the basis of exemplary embodiments with the accompanying drawings, in which:

DESCRIPTION OF THE INVENTION

In the figures like reference signs are used for elements corresponding to one another.

Figure 1:
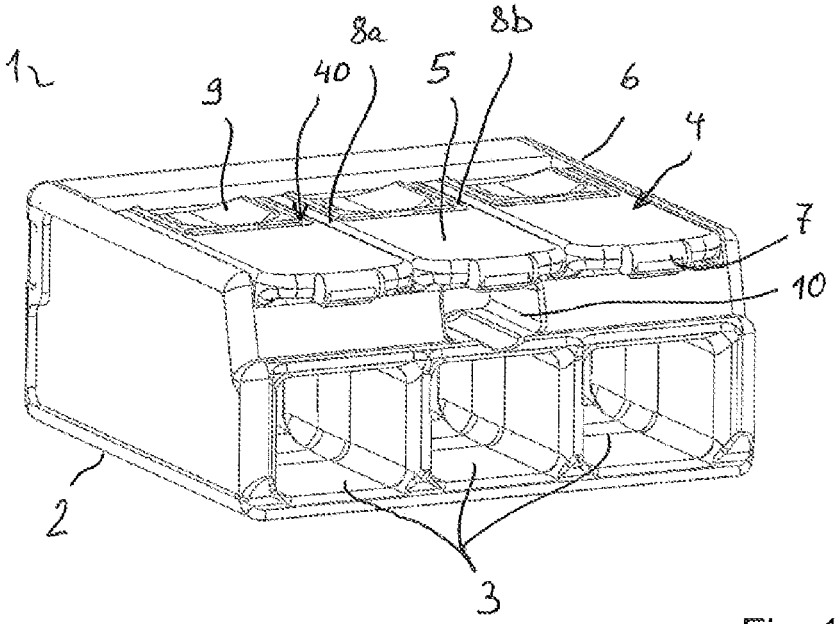
FIG. 1—shows a perspective view of a first embodiment of a conductor terminal.

FIG. 1 shows a perspective view of a first embodiment of a conductor terminal 1. The conductor terminal has an insulating material housing 2 with adjacently arranged conductor insertion openings 3 introduced into the insulating material housing from the front. A spring-loaded clamping connection (not visible) arranged in the insulating material housing 2 and associated with a conductor insertion opening 3 is accessible via each of the conductor insertion openings 3. When inserting an electrical conductor into a conductor insertion opening 3, said conductor can be clamped electrically conductively and in a mechanically secured manner at the associated spring-loaded clamping connection.

An actuation element 4 is arranged above a respective conductor insertion opening. The actuation elements 4 are each mounted in the insulating material housing 2 so as to be pivotable about an axis of rotation. They have a transverse web 5 at the free end, which, as illustrated, lies in the closed position within the volume formed by the insulating material housing 2. The transverse webs 5 of the actuation elements 4 preferably terminate flush with the plane spanned by the upper edge 6 of the insulating material housing 2.

It is clear that the transverse webs 5 at a free end have a protruding bead 7, which facilitates the grasping of the actuation element 4 by hand or a screwdriver in order to apply a lever pivot force to the actuation element 4, from bottom to top in the viewing direction, and to therefore pivot said actuation element.

The transverse web 5 of an actuation element 4 connects two mutually distanced side wall portions 8*a*, 8*b* in order to form an actuation lever that is U-shaped in section in principle. The free space 40 between two side wall portions 8*a*, 8*b* and bordering the transverse web 5 is filled in the closed position by a raised portion 9 of the insulating material housing 2. The free space 40 is thus used to accommodate insulating material in order to thus achieve a compact design of the conductor terminal 1.

It can also be seen that an inspection opening 10 open at the end face is provided above the middle conductor insertion opening. An inspection tool, such as a measuring pin or a screwdriver with inspection light for measuring the voltage potential at the spring-loaded clamping connection arranged therebehind can thus be inserted into the inspection opening 10.

Figure 2:
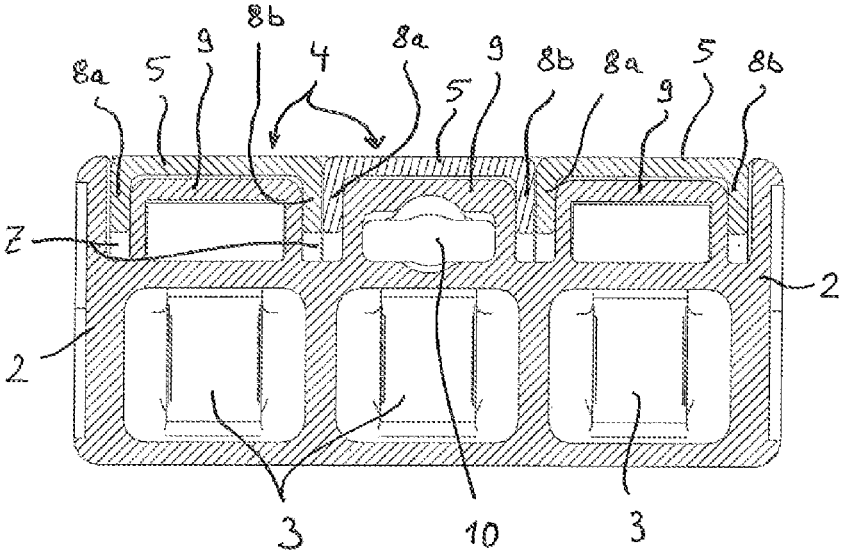
FIG. 2—shows a cross-sectional view through the conductor terminal from FIG. 1.

FIG. 2 shows a cross-sectional view through the conductor terminal 1 from FIG. 1. It is clear that the actuation elements 4 are U-shaped in cross section by the mutually distanced side walls 8*a*, 8*b* and the transverse web 5 connecting said side walls. It is clear that the side wall portions 8*a*, 8*b* in the closed position enter a respective intermediate space Z between the raised portion 9 of the insulating material housing and either an adjacent raised portion or, for the edge regions, the side wall of the insulating material housing 2. This leads to an optimized side guidance of the actuation elements 4, which are therefore mounted not only at the visible rotary bearing. In the illustrated exemplary embodiment two side wall portions 8*a*, 8*b* of adjacent actuation elements 4 border one another and enter a common intermediate space Z, so that the side wall portions 8*a*, 8*b* of the adjacent actuation elements 4 guide one another mutually. Installation space in the width direction is saved due to the omission of a further intermediate wall between two adjacent side wall portions 8*a*, 8*b*.

Figure 3:
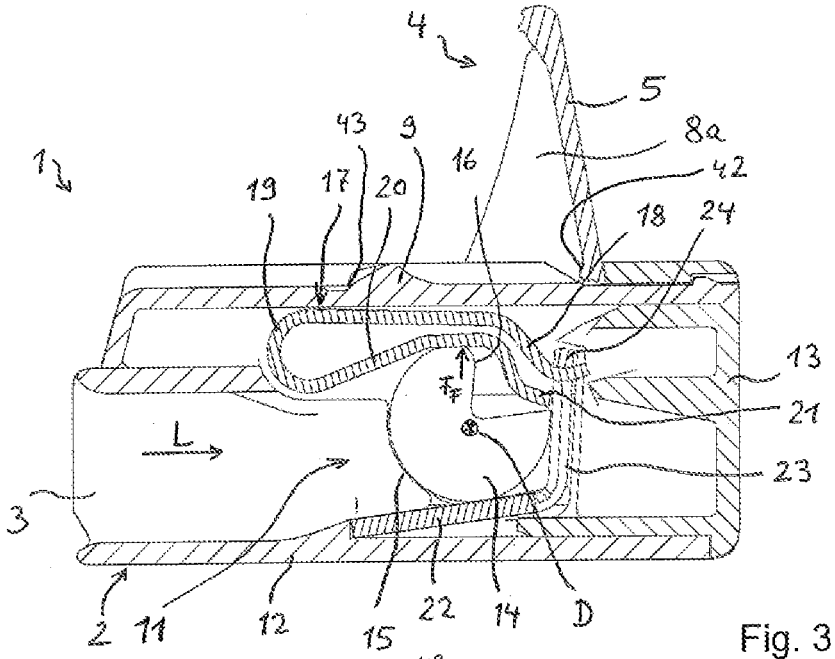
FIG. 3—shows a side sectional view through the conductor terminal from FIG. 1 with open actuation element.

FIG. 3 shows a side sectional view through the conductor terminal 1 from FIG. 1 with open actuation element 4.

It can be seen that a spring-loaded clamping connection 11 together with an associated actuation element 4 is installed in the insulating material 2. Here, the insulating material housing 2 is formed in two parts and has a terminal housing part 12 and a cover part 13. Following insertion of the actuation element 4 and of the spring-loaded camping connection 11 into the terminal housing part 2, this is closed by the cover part 13. Here, a pivot bearing region 14 inter alia with a part-circle outer periphery is guided on part-circle bearing cavities 15 of the insulating material housing 2 in order to mount the pivot bearing region 14 pivotably about an axis of rotation D. The axis of rotation D is here a virtual axis of rotation, which is defined by the part-circle pivot bearing region 14 and the rotary mounting thereof in the insulating material housing 2.

It can be seen that the pivot bearing region 14 has an actuation portion 16 for acting on a lateral portion of the clamping spring 17 of the spring clamping connection 11. Here, the clamping spring 17 is formed from a contact limb 18, an adjoining spring arc 19, and a clamping limb 20 adjoining said spring arc. The clamping limb 20 has, at its free end, a clamping edge 21, which together with a bus bar 22 of the spring-loaded clamping connection 11 forms a clamping point for clamping an electrical conductor.

It is clear that in the illustrated position of the actuation element 4 pivoted into the open position the clamping limb 20 is displaced away from the bus bar 22 arranged therebeneath in order to open the clamping point formed by the clamping edge 21 of the clamping spring 17 and the bus bar 22. For this purpose the actuation portion 16 exerts a spring actuation force FF, which, as considered in the conductor insertion direction L, lies in front of the axis of rotation and is directed upwardly from the bus bar 22 in the direction of the free end of the actuation element in the open position. In the illustrated exemplary embodiment the bus bar 22 is provided with a frame portion 23, which is formed integrally therewith and which is directed upwardly from the plane of the bus bar 22 in the extension direction of the attached actuation element 4 and of the contact limb 17. A conductor feedthrough opening is formed in the frame part 23 by two mutually distanced side webs and by a retaining web 24 connecting the side webs at the free end. The contact limb 18 engages the retaining web 24 from below and is secured in the retaining web 24 by a slight curvature. A self-supporting spring-loaded clamping connection 11 is thus created, with which the clamping spring 17 is arranged on the bus bar 22 and a force acting on the clamping limb 20 is returned to the bus bar 22 via the contact limb 17. When clamping an electrical conductor, the clamping limb 20 exerts a force onto the bus bar 22, which counteracts the retaining force of the contact limb 18 at the retaining web 24, such that the two forces are compensated for to the greatest possible extent.

It is clear that the pivot bearing region 14 is supported opposite the clamping limb 20 on the bus bar 22, is guided on the bearing cavities 15 of the insulating material housing 2 by means of a part-circle outer periphery, and additionally is mounted in the rear region opposite the bearing cavities 15 on the side webs of the frame part 23. It is thus ensured that the actuation forces exerted by the pivot lever are received in a self-supporting manner without exertion of considerable deformation forces on the insulating material housing.

Figure 4:
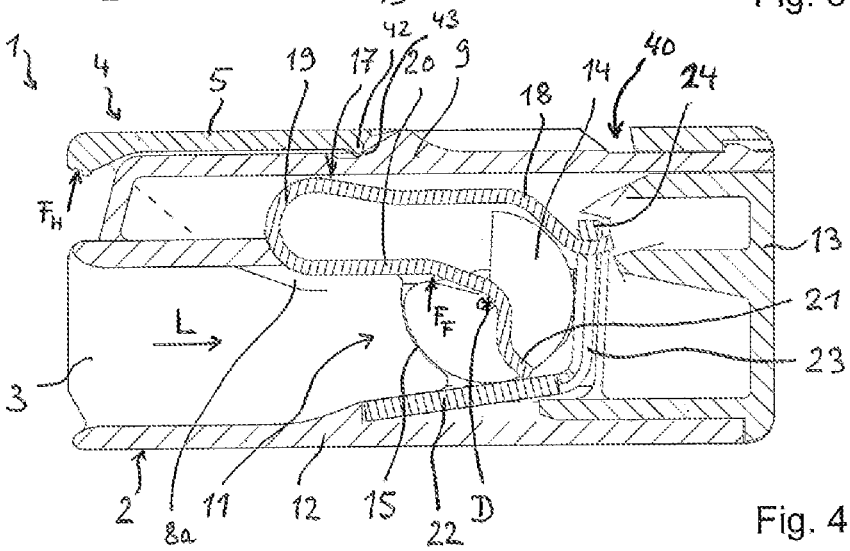
FIG. 4—shows a side sectional view through the conductor terminal from FIG. 1 with closed actuation element.

FIG. 4 shows a side sectional view of the conductor terminal 1 from FIGS. 1 to 3. Here, the actuation element 4 is located in the closed position, in which the actuation element 4 is pivoted via its transverse web 5 in the direction of the insulating material housing 2 and a clamping point formed by the spring force clamping connection 11 for clamping an electrical conductor is closed. Here, the clamping edge 21 of the clamping limb 20 rests on the bus bar 22 without electrical conductor, preferably under spring force of the clamping spring 17.

In order to now open the clamping point, a lever actuation force FH has to be exerted onto the lever arm formed by the side webs 8*a* and the transverse web 5. This actuation force FH is directed upwardly in the illustration from the plane of the bus bar 22 in the direction of clamping springs 17 arranged thereabove. In the event of a resultant pivot of the actuation element 4 in the clockwise direction in the illustration, a spring actuation force FF is exerted by the actuation portion 16 onto the clamping limb 20. This spring actuation force FF is also directed upwardly, i.e. from the bus bar 22 in the direction of the extension direction of the actuation element 4 in the open position (see FIG. 3). The extent to which the spring actuation force FF and the lever pivot force FH run here at a certain identical or different angle is irrelevant.

It can be seen that, from the closed position according to FIG. 4 in the transition to the open position according to FIG. 3, the lever pivot force FH and spring actuation force FF are not only both directed in the same direction, i.e. upwardly independently of their specific angle, but also lie on the same side relative to axis of rotation D as considered in the conductor insertion direction L. The actuation element 4 therefore does not form a lever arm with which, by means of a lever pivot force on one side of the axis of rotation, a spring actuation force FF is exerted on the other opposite side of the axis of rotation D. Rather, the lever pivot force FH and the spring actuation force FF act on the same side relative to the axis of rotation D.

It is also clear from FIG. 4 that the spring-loaded clamping connection 11 enters partially into the space delimited laterally by the side wall portions 8*a*, 8*b* and the transverse web 5, such that the overall height of the conductor terminal 1 is relatively low in spite of the actuation element 4. It is also clear that a portion 9 of the insulating material housing 2 located above the spring-loaded clamping connection 11 enters a free space 40 of the actuation element 4 bordering the transverse web 5. This free space 40 is thus also used to accommodate parts of the insulating material housing in order to enable a compact design.

In the closed position of the actuation element 4 this is latched by a detent lug 42, protruding from the transverse web 5, on an associated detent contour 43 of the insulating material housing 2. In the closed position the actuation element 4 is not loaded by force by the clamping spring 17 and is thus stabilized in terms of position. An uncontrolled wobbling motion of the actuation element 4 is thus prevented by the latched connection.

Figure 5:
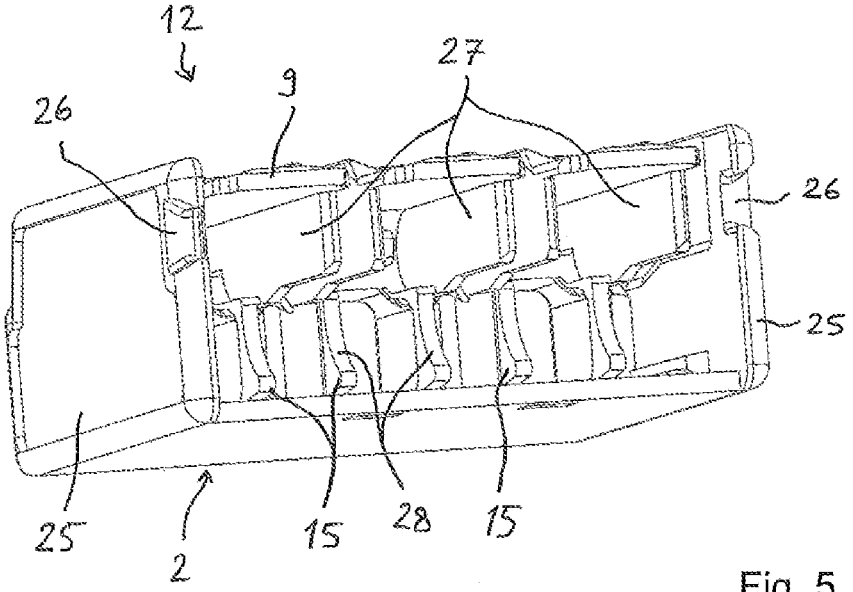
FIG. 5—shows a perspective view of a terminal housing part of the insulating material housing of the conductor terminal from FIGS. 1 to 4.

FIG. 5 shows a perspective view of the terminal housing part 12 of the insulating material housing 2 of the above-described conductor terminal 1. Dovetail-like recesses 26 are formed in the side walls 25 of the insulating material housing 2, into which recesses dovetail-like protrusions of an associated cover part 13 matched to said recesses enter in order to prevent a widening of the insulating material housing 2 under load. The latched connection between terminal housing part 12 and cover part 13 is provided via detent elements (not illustrated in greater detail).

It is also clear that guide webs 27 and bearing cavities 15 with end faces 28 that are curved over part of a circle are formed in the interior of the terminal housing part 12. With the aid of these end faces 28 that are curved over part of a circle and that are each combined with a bearing cavity 15, a pivot bearing of an associated pivot bearing region 14 relative to an actuation element 4 is provided. The guide webs 27 enter a guide slot 30 (see FIG. 7), which is provided between the inner wall of a side wall portion 8*a*, 8*b* and an actuation portion 16 distanced therefrom. The guide webs 27 are additionally also used to stabilize the terminal housing part 12.

Figure 6:
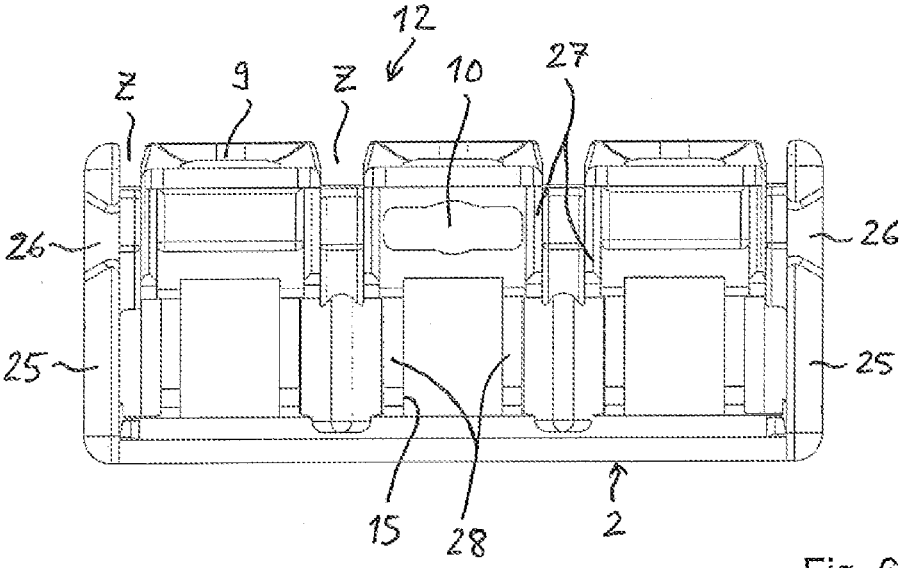
FIG. 6—shows a rear view of the terminal housing part from FIG. 5.

FIG. 6 shows a rear view of the terminal housing part 12 from FIG. 5. Here, it is clear that the end-face central inspection opening 10 is open not only on the front side, as can be seen in FIG. 1, but also toward the interior. A spring-loaded clamping connection 11 formed in the interior of the terminal housing part 12 is thus accessible for an inspection tool in order to check whether electrical voltage potential is present at the spring-loaded clamping connection 11 in question.

It is also clear from FIG. 6 that an intermediate space Z, in which the side wall portions 8*a*, 8*b* of the incorporated actuation elements 4 enter, is provided in each case in the intermediate space between adjacent guide webs 27 of bordering mounting spaces for spring-loaded clamping connections 11.

Figure 7:
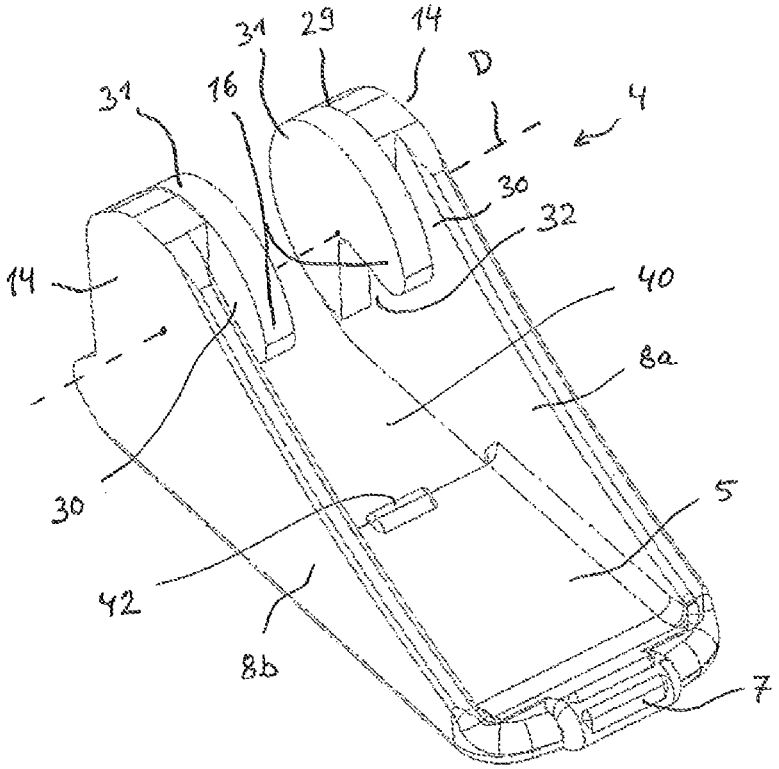
FIG. 7—shows a perspective view of an actuation element of the conductor terminal from FIGS. 1 to 4.

FIG. 7 shows a perspective view of an actuation element 3 in the form of an actuation lever from the underside. From this, the embodiment, which is U-shaped in section in principle, with two mutually distanced side wall portions 8*a*, 8*b* can be seen, which at their free end are connected to one another via a side edge by means of a transverse web 5. It is clear that the side wall portions 8*a*, 8*b* taper from the pivot bearing regions 14 to the free end. It can be seen that an actuation bead 7 is provided at the free end of the transverse web 5. It is also clear that the transverse web 5 with the actuation bead 7 protrudes forwards beyond the free ends of the side wall portions 8*a*, 8*b*, wherein the inner sides of the transverse web 5 are inclined at the free end edge. Any slipping when applying a lever actuation force of the actuation element 4 is thus counteracted.

It can also be seen that the pivot bearing regions 14 have outer end faces 29 curved over part of a circle, by means of which the actuation element 4 is mounted in the insulating material housing so as to be pivotable about a virtual axis of rotation D.

The axis of rotation D extends through the center of a part circle formed by the outer end face 29.

It can also be seen that part-circle portions 31 distanced from the side wall portions 8*a*, 8*b* in the pivot bearing region 14 via a guide slot 30 are arranged with a V-shaped incision 32. An actuation portion 16 is formed in the region of each V-shaped incision 32 and is used to apply a spring actuation force to an associated clamping limb 20 of a clamping spring 17. It can be seen that the actuation portions 16, as well as the transverse web 5, onto which a lever pivot force FH is exerted, lie on the same side relative to the axis of rotation D. As a result, the spring actuation forces FF exerted via the actuation portions 16 act on the same side relative to the axis of rotation D as the lever pivot force FH applied to the transverse web 5 in order to provide a pivot motion.

It is additionally clear that a latching lug 42 protrudes approximately in the direction of the pivot bearing region 14 and the portion 31 from the transverse web 5 on the side opposite the actuation bead 7. The latching lug 42 is used to latch the actuation element 4 in the closed position with the insulating material housing 2.

Figure 8:
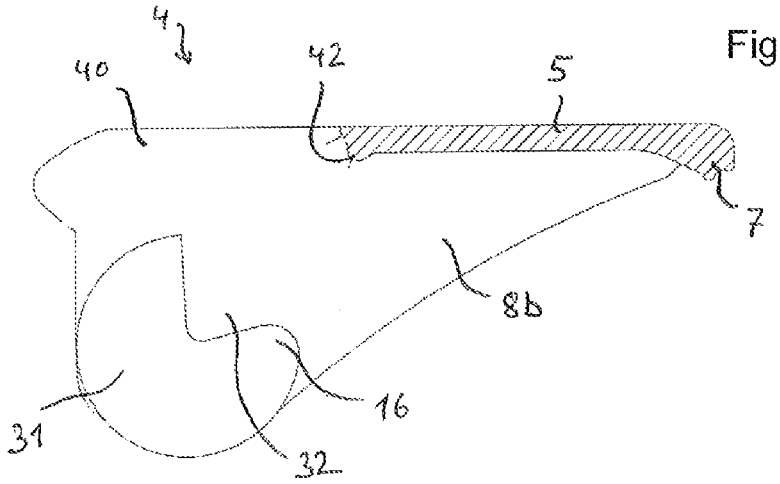
FIG. 8—shows a side sectional view through the actuation element from FIG. 7.

FIG. 8 shows a side sectional view through the actuation element 4 from FIG. 7. Here, it is again clear that the side wall portions 8*a*, 8*b* are connected by a transverse web 5 connecting them on the upper side of the actuation element 4. The transverse web 5 extends here only over part of the length of the side wall portions 8*a*, 8*b* and preferably occupies more than half of the length of the side wall portions 8*a*, 8*b*.

Figure 9:
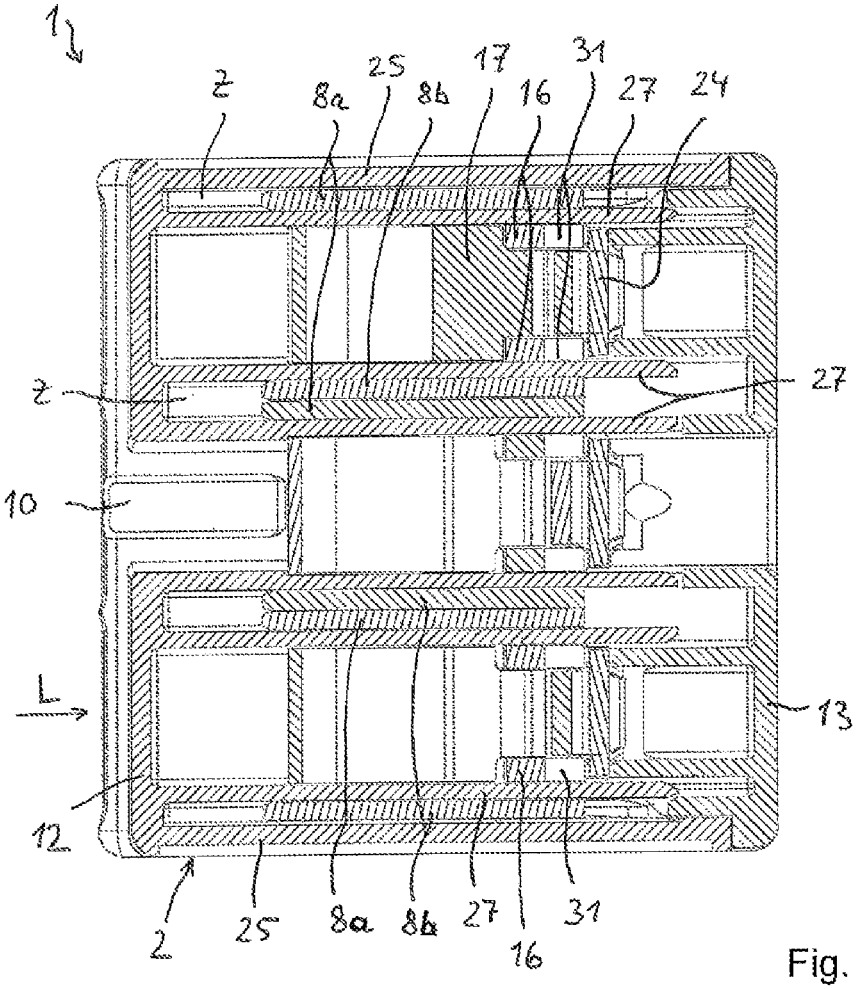
FIG. 9—shows a longitudinal sectional view through the conductor terminal from FIG. 1.

FIG. 9 shows a longitudinal sectional view through a conductor terminal 1 in plan view, in which it is clear that the mutually distanced side wall portions 8*a*, 8*b* of the respective actuation lever 4 enter intermediate spaces Z of the insulating material housing 2 and are guided there by wall portions of the insulating material housing 2 and where applicable by bordering side wall portions 8*a*, 8*b* of adjacent actuation elements 4. It is clear here that a guide web 27 of the insulating material housing 2 enters the guide slot 30 between a side wall portion 8*a*, 8*b* and a bordering portion 31 with the actuation portion 16. A pivot bearing guidance is therefore created for the actuation element 4 and also holds this laterally against tilting or twisting.

It can also be seen that the portions 31 with the actuation portions 16 overlap the clamping spring 17 in the width direction and cooperate with edge regions of the associated clamping spring 17 or clamping limb 20 thereof in order to exert a spring actuation force FF onto the clamping limb 20. A guide web 27 then adjoins the outer edges of the clamping spring 17 and of the actuation portions 16 and enters the guide slot 30 of the actuation element 4. The intermediate space Z bordering hereon is then intended to accommodate part of a side wall portion 8*a*, 8*b* of the actuation element 4. The actuation portions 16 are connected integrally to the side wall portions 8*a*, 8*b* via the portion 31.

Figure 10:
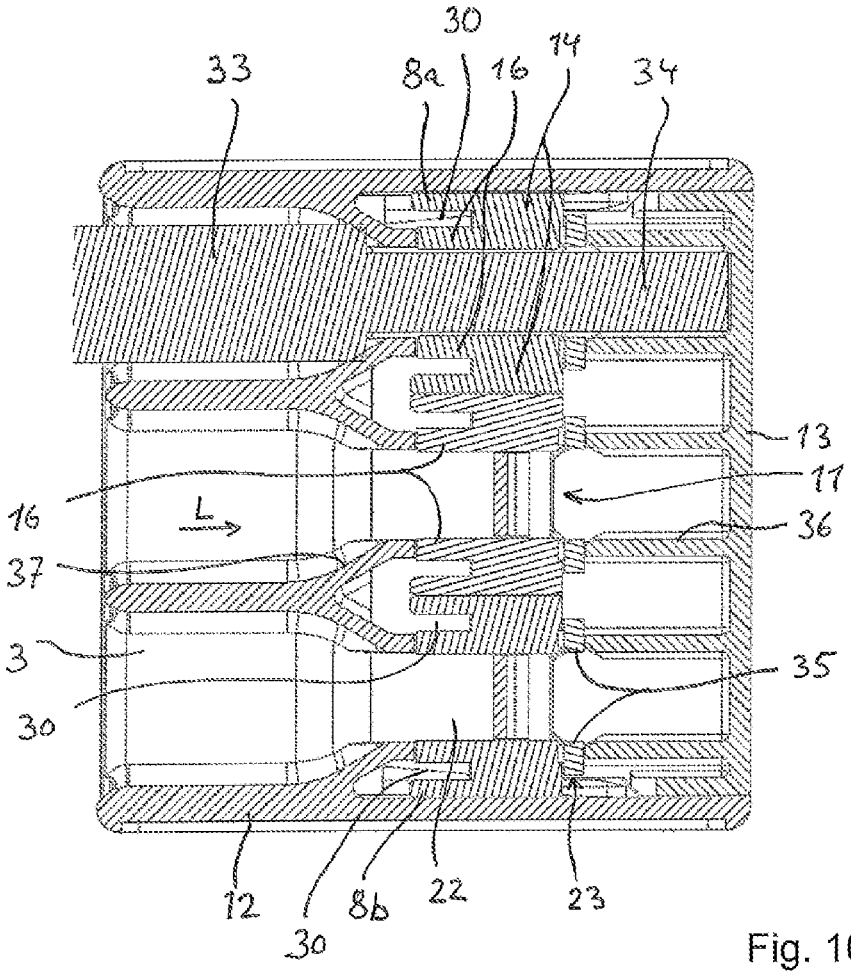
FIG. 10—shows a longitudinal sectional view through the conductor terminal from FIG. 1 with inserted electrical conductor.

FIG. 10 shows a longitudinal sectional view through the conductor terminal 1 from FIGS. 1 and 9 approximately in line with the axis of an inserted electrical conductor 33. The electrical conductor 33 has a stripped free end 34, which is electrically conductively connected at a clamping point by means of the clamping spring 17 to the electrically conductive bus bar 22 arranged therebeneath. The bus bar 22 extends here transversely to the direction of connection, i.e. beyond the three adjacently arranged spring-loaded clamping connections 11, in order to thus enable a transverse distribution of the electrical potential at the electrical conductor 33.

It is clear from this sectional view that pivot bearing regions 14 border the connection space for the electrical conductors 33 laterally, the portions 31 having actuation portions 16. The actuation portions 16 of adjacent pivot bearing regions 14 for the same spring-loaded clamping connection and the same conductor insertion opening 3 are distanced from one another to a shorter extent than the side wall portions 8*a*, 8*b*, on which the actuation portions 16 are formed integrally. A guide slot 30 is located between the actuation portions 16 and the side wall portions 8, 8*b*. The pivot bearing regions 14 and/or the actuation portions 16 here guide the electrical conductor 33 or stripped end thereof to the clamping point.

It is also clear that the frame parts 23 protruding from the bus bar 26 each have two edge webs 35 distanced from one another, of which the intermediate space serves as a conductor feedthrough opening for feeding through the stripped end 34 of an electrical conductor 33.

It can also be seen that the spring-loaded clamping connections 11 are fixed by the cover part 13 in the terminal housing part 12 in such a way that webs 36 of the cover part contact the edge webs 35 of the frame parts 23 and thus fix the position. The terminal housing part 12 has wall portions 37 made of insulating material with part-circle end faces, which contact the portions 31, curved over part of a circle, of the pivot bearing regions 14 with the actuation portions 16 and for this purpose form a part-circle bearing cavity.

It is advantageous when the insulating material housing 2 or at least parts or portions thereof is/are formed from transparent plastic material in order to be able to thus identify externally whether the stripped free end 34 of an electrical conductor 33 is correctly inserted.

Figure 11:
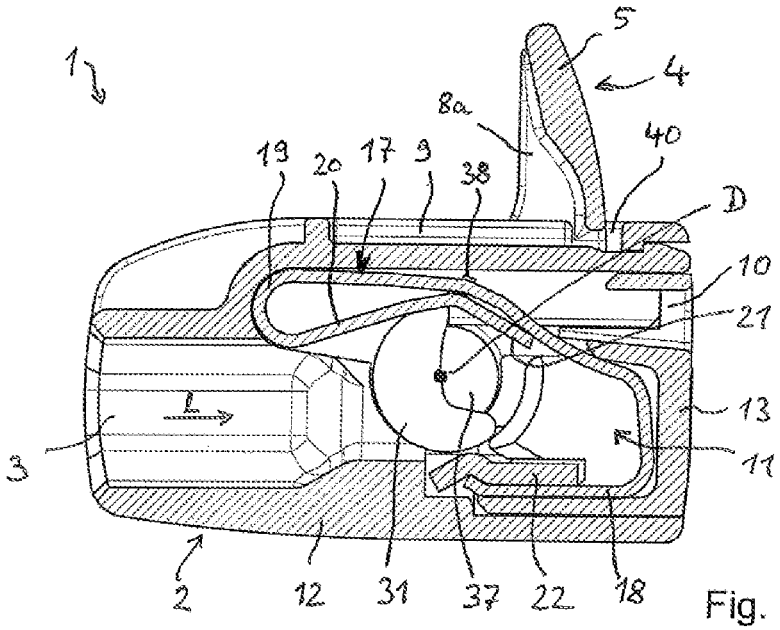
FIG. 11—shows a side sectional view through a second embodiment of a conductor terminal with open actuation element.

FIG. 11 shows a side sectional view of a second embodiment of a conductor terminal 1 when the actuation element 4 is opened in the open state. Here as well the insulating material housing 2 is formed in two parts from a terminal housing part 12 and a cover part 13 introduced thereinto and latched with the terminal housing part 12. In this embodiment the pivot bearing region 14 has a first at least part-circle bearing region 37, which is adjoined by the actuation portion 16 in the direction of the conductor terminal space offset from the portion 31. It is clear that this portion 31 with the actuation portion 16 has a larger diameter than the part-circle bearing portion 37. The portion 31 with the actuation portion 16 thus protrudes radially relative to the rotary bearing portion 37. The actuation element 4 can then be mounted on the rotary bearing region 37 by suitably matched part-circle bearing cavities of the insulating material housing 2, and where applicable can also be mounted on the larger part-circle portion 31 by the insulating material housing. The pivot bearing and resistance to tilting with reduced loading of the insulating material housing material is thus improved also in conjunction with the protrusion, which may be bordered laterally by an insulating material housing wall for guidance.

Figure 12:
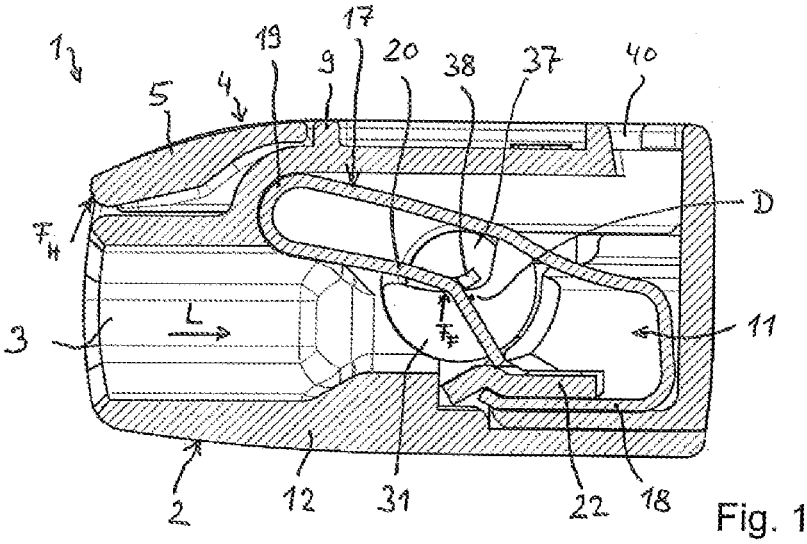
FIG. 12—shows a side sectional view through the conductor terminal from FIG. 11 with closed actuation element.

With this embodiment as well the spring actuation force FF of the actuation portion 16 acts on actuation tabs 38, protruding from the clamping spring, on the same side of the axis of rotation D and in the same direction as a lever pivot force FH to be applied to the free end of the actuation element 4 in order to pivot the actuation element 4 from the closed position according to FIG. 12 into the illustrated open position of FIG. 11.

Both forces, i.e. the lever pivot force FH and the spring actuation force FF are directed here upwardly in the same direction, i.e. away from the bus bar 22 in the extension direction of the actuation element 4 in the open position irrespective of the exact angular position.

The conductor terminal 1 may have an inspection opening 39 in the insulating material housing 2, which inspection opening is accessible from above in the rear region.

The invention claimed is:

1. A conductor terminal comprising:

an insulating material housing comprising a conductor insertion opening;

at least one spring-loaded clamping connection in the insulating material housing; and at least one actuation element pivotably accommodated in the insulating material housing and configured to open at least one spring-loaded clamping connection associated with the at least one actuation element, wherein said conductor insertion opening is configured to guide an electrical conductor to the spring-loaded clamping connection, wherein the at least one actuation element comprises i) two side wall portions spaced from one another and at least partially entering the insulating material housing ii) a pivot bearing region, wherein opposite said pivot bearing region the at least two sidewall portions are connected to each other by a transverse web to form a lever arm, wherein the at least one actuation element is pivotably mounted in the insulating material housing with the pivot bearing regions of the mutually distanced side wall portions of an actuation element, and wherein the spring-loaded clamping connection associated with the at least one actuation element is at least partially accommodated in a space between the pivot bearing region of the at least one actuation element, the pivot bearing region having actuation portions configured to act on an associated clamping spring of a spring-loaded clamping connection as the actuation element pivots from a closed position, in which the at least one actuation element is pivoted in a position such that the associated transverse web is adjacent the insulating material housing and a clamping point formed by the spring-loaded clamping connection for clamping an electrical conductor is closed, into an open position, in which the at least one actuation element is pivoted in a position such that the associated transverse web is away from the insulating material housing and a clamping point formed by the spring-loaded clamping connection for clamping an electrical conductor is open, and wherein the adjacent side wall portions of two actuation elements arranged adjacently in the insulating material housing directly border one another, wherein the pivot bearing region is configured to guide the electrical conductor to the clamping point, wherein a wall of the conductor insertion opening extends in insertion direction of the electrical conductor towards the clamping point for guiding the electrical conductor through a clamping limb of the clamping spring which adjoins the wall, so that the guidance of the electrical conductor is provided by the walls of the conductor insertion opening, by the clamping limb of the clamping spring and by the pivot bearing region.

2. The conductor terminal as claimed in claim 1, wherein the at least one actuation element is coordinated with the insulating material housing and the associated spring-loaded clamping connection such that i) the lever pivot force acting on the transverse web for pivoting the actuation element from the closed position into the open position and ii) a spring actuation force acting on the clamping spring by the actuation portions when pivoting the actuation element from the closed position into the open position act on the same side relative to the axis of rotation.

3. The conductor terminal as claimed in claim 1, wherein the actuation portions are arranged on the pivot bearing regions of the side wall portions at a distance from one another that is shorter than the distance between the side wall portions, wherein the actuation portions extend parallel to the side wall portions and are formed integrally with the side wall portions, such that in each case a guide slot is provided between an actuation portion and the associated, directly adjacent side wall portion, and in that a guide web of the insulating material housing in each case enters an associated guide slot for guiding the actuation element in the event of a pivot motion about an axis of rotation in the pivot bearing region.

4. The conductor terminal as claimed in claim 1, wherein the insulating material housing comprises a terminal housing part and a separate cover part, wherein the terminal housing part and the cover part are connected to one another in the assembled state via the at least one spring-loaded clamping connection, inserted into the terminal housing part, and associated actuation element, and wherein the pivot bearing region is accommodated in a space formed between the terminal housing part and cover part.

5. The conductor terminal as claimed in claim 4, wherein at least one of the terminal housing part or the cover part comprises part-circle bearing cavities for pivotably mounting the actuation element in the insulating material housing, wherein a partial-circle outer periphery of the pivot-bearing region is matched with the partial-circle bearing cavity entering an associated bearing cavity.

6. The conductor terminal as claimed in claim 1, wherein the actuation portions comprise a partial-circle outer periphery with a cutout for forming a step protruding in the direction of the center of the actuation portion, wherein the at least one spring-loaded clamping connection comprises a bus bar and a clamping spring with an actuation tab, and the actuation tab of the clamping spring rests on the step as the actuation element is pivoted in order to open a clamping point formed between a clamping edge of the clamping spring and the bus bar for clamping an electrical conductor.

7. The conductor terminal as claimed in claim 1, wherein the side wall portions of an actuation element are connected to one another by means of a transverse web, which, in the state in which the actuation element is pivoted up and the clamping point is open, extends from a free end of the side wall portions to the insulating material housing.

8. The conductor terminal as claimed in claim 1, wherein the transverse web protrudes beyond the free end of the side wall portions opposite the pivot bearing region.

9. The conductor terminal as claimed in claim 1, wherein two or more spring-loaded clamping connections are accommodated adjacently in the insulating material housing, the spring-loaded clamping connections comprising a common bus bar.

10. The conductor terminal as claimed in claim 1, wherein the pivot bearing regions are mounted on a portion of a bus bar of the associated spring-loaded clamping connection.

11. The conductor terminal as claimed in claim 1, wherein outer contours of the actuation portions lie in a space between a plane spanned by a bus bar of the associated spring-loaded clamping connection and a plane spanned by a contact limb of the associated spring-loaded clamping connection.

* * * * *